US006612347B2

(12) United States Patent
Hill

(10) Patent No.: US 6,612,347 B2
(45) Date of Patent: Sep. 2, 2003

(54) APPARATUS FOR METERING AND PACKAGING BULK PARTICULATE MATERIAL

(75) Inventor: David J. Hill, Racine, WI (US)

(73) Assignee: Spee-Dee Packaging Machinery, Inc., Sturtevant, WI (US)

( * ) Notice: Subject to any disclaimer, the term of this patent is extended or adjusted under 35 U.S.C. 154(b) by 50 days.

(21) Appl. No.: 10/062,966

(22) Filed: Jan. 31, 2002

(65) Prior Publication Data

US 2003/0089421 A1 May 15, 2003

Related U.S. Application Data

(60) Provisional application No. 60/345,968, filed on Nov. 9, 2001.

(51) Int. Cl.[7] ..... B65B 1/20

(52) U.S. Cl. ..... 141/83; 141/98; 141/102; 141/105; 222/77; 222/192; 222/370

(58) Field of Search ..... 141/83, 98, 100, 141/102, 105, 129, 144, 166, 177, 250, 266; 222/77, 192, 305, 307, 352, 367, 370

(56) References Cited

U.S. PATENT DOCUMENTS 2,540,256 A * 2/1951 Haugen ..... 222/307
4,880,150 A * 11/1989 Navin et al. ..... 222/346
5,082,032 A * 1/1992 Crocker ..... 141/1

* cited by examiner

*Primary Examiner*—Gregory L. Huson
*Assistant Examiner*—Peter deVore
(74) *Attorney, Agent, or Firm*—Patterson, Thuente, Skaar & Christensen, L.L.C.

(57) ABSTRACT

A metering and packaging device includes several cups fixed to rotate about a shaft. These cups are positioned under hopper outlets during a portion of their rotation to receive bulk material, and over passages through a bottom plate during another portion of their rotation to dump bulk material into weigh buckets. The outlets, cups and passages through the bottom plat are angularly displaced from one another such that the cups drop measured portions of bulk material in an alternating fashion into the weigh buckets, and the weigh buckets drop the portions into a packaging machine in an alternating fashion into a packaging machine which separately packages each successive and alternately dropped portion.

14 Claims, 4 Drawing Sheets

APPARATUS FOR METERING AND PACKAGING BULK PARTICULATE MATERIAL

CROSS-REFERENCE TO RELATE APPLICATION, IF ANY

This application is based on U.S. Provisional patent application Serial No. 60/345,968 which was filed on Nov. 9, 2001 and is entitled "Apparatus For Metering And Packaging Bulk Particulate Material".

FIELD OF THE INVENTION

The invention relates to metering and packaging machinery for bulk particulate or flaked dry material.

BACKGROUND OF THE INVENTION

Vertical form, fill and seal machines are used for a wide variety of products, ranging from foodstuffs to soaps and cleansers. In essence, these machines take a ribbon of bag material on a roll, wrap it around a hollow tube, and form a seal running longitudinally to make a hollow film tube. The tubes are formed around a vertical column with a hollow interior through which the material being packaged is introduced. A heating apparatus at the bottom seals the tube to close it at one end. After the longitudinal seal has been formed and the transverse seal at the bottom made, the bulk material being packaged is introduced into what is now a tube with a closed end. Once the appropriate amount of material has been introduced, the tube is pulled downwards (or the heating bar is moved upwards) and the bottom portion of the tube with the packaged bulk material is sealed at the top. Once sealed, a cutter cuts off the lower portion of the tube with the material sealed inside and the bag produced thereby is released into the remaining part of the manufacturing process where it is typically placed in a box and then in a case for shipping.

Each of these machines is quite expensive. As a result, they are operated as fast as possible. This, in turn, requires a steady stream of measured volumes of bulk material to be packaged. Traditional methods of volumetrically measuring bulk material have not been satisfactory with these high-speed machines. For that reason, it has been the practice to use a multiple bin feed system called a combination scale. In these systems, many hoppers are simultaneously and continuously fed from a single material source. A computer control system measures these hoppers, and opens the hopper or hoppers having the appropriate amount of material. Since the feed rate cannot be controlled with any precision, there are typically fifteen to twenty of these hoppers that are simultaneously fed. With that number of hoppers being simultaneously fed and weighed, it is generally true that at least one hopper (or a combination of two or more hoppers) will have the appropriate amount of material to fill the bag every time a new portion of bulk material is required.

These combination scale feeding systems, however, are expensive. Since every hopper has its own electronic measuring device, and since there are so many hoppers required to ensure that one or two of them will have the right quantity of material, they are very complex, very large, and very expensive. Changing from one material to another material requires an extensive down time in which the fifteen or twenty-five hoppers are cleaned and sanitized.

What is needed therefore is an improved system for volumetrically measuring and metering bulk materials that operates at high speed. What is also needed is a system for volumetrically measuring and metering such material and subsequently individually packaging such material in a form fill machine that is more compact, less costly, and easier to use than the previous system. What is also needed is a system that will sequentially and alternately release volumetrically measured quantities of bulk material from a plurality of weigh buckets. It is an object of this invention to provide such an apparatus.

BRIEF DESCRIPTION OF THE DRAWINGS

The present invention will become more fully understood from the following detailed description, taken in conjunction with the accompanying drawings, wherein like reference numerals refer to like parts, in which.

SUMMARY OF THE INVENTION

Figure 1:
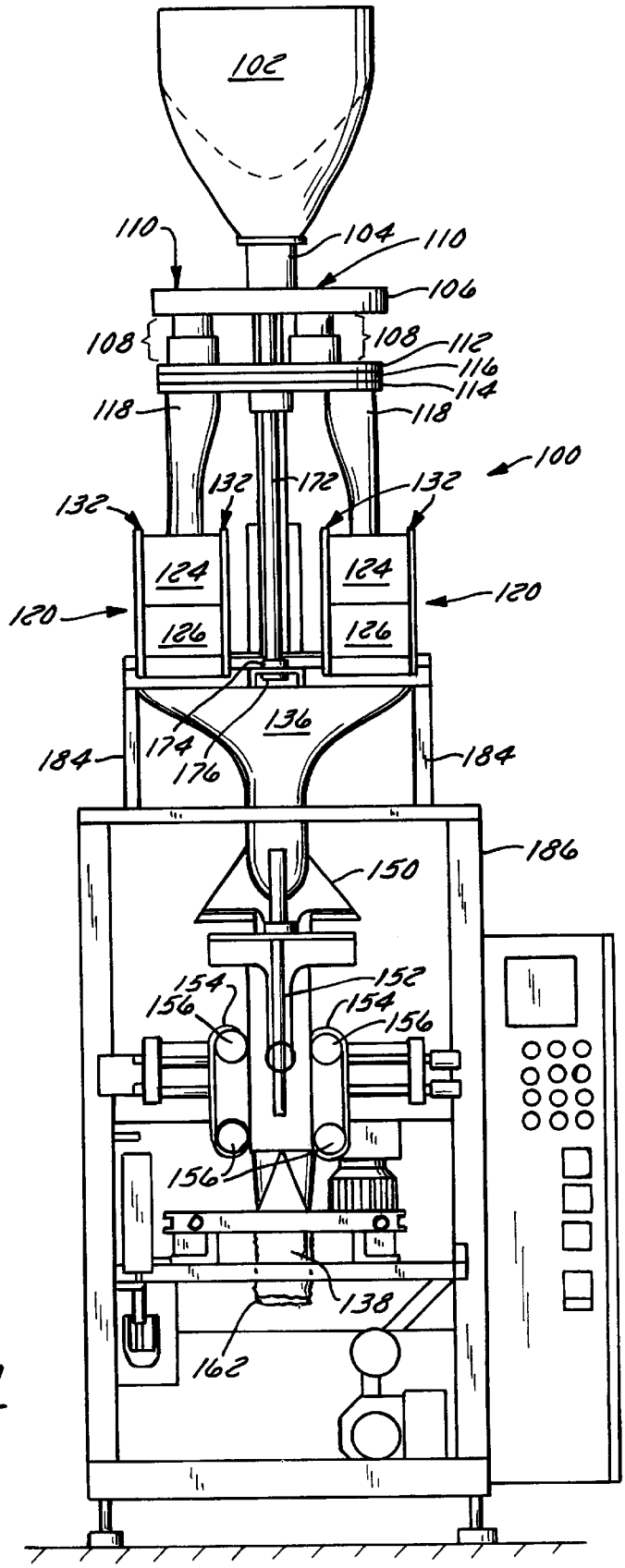
FIG. 1 is a front view of metering and packaging apparatus in accordance with the present invention.

In accordance with a first embodiment of the invention, an apparatus for volumetrically metering, weighing, and dispensing particulate or flaked material, is provided that includes a hopper having an inlet and first and second outlets that is configured to receive and distribute the material through the outlets; a top plate disposed horizontally and fixed to a shaft to rotate with the shaft about a vertical axis and having first, second, and third passages extending through the top plate; a cup holder plate disposed horizontally and fixed to the shaft to rotate with the shaft about a vertical axis and having first, second, and third openings extending through the bottom plate; first, second and third cups extending vertically and fixed between the first, second and third openings of the top and cup holder plates; a bottom plate abutting the cup holder plate and having first and second passages therethrough; first and second weigh buckets disposed below the first and second passages through the bottom plate to receive material passing through the first and second passages in the bottom plate; and a motor drive unit drivingly coupled to the shaft to rotate the top plate, and the cups with respect to the bottom plate and the first and second weigh buckets; wherein the first and second outlets of the hopper, the first, second and third cups and the first and second passages through the bottom plate are angularly disposed with respect to each other such that when the top plate, cups and cup holder plate are rotated by the motor drive unit, the cups empty into the weigh buckets in an alternating sequence and the hopper fills the cups in an alternating sequence.

The hopper outlets may be disposed in a 180-degree relation with respect to each other about the axis of the shaft. The passages in the bottom plate may be disposed in a 180-degree relation with respect to each other about the axis of the shaft. The cups may be disposed in a 120-degree relation with respect to each other about the axis of the shaft. Each hopper outlet may be spaced 90 degrees from each passage in the bottom plate about the axis of the shaft. The motor drive unit may be configured to drive the cups about the shaft in at least six start-stop rotational sequences.

In accordance with a second embodiment of the invention, an apparatus for volumetrically metering, weighing, and dispensing particulate or flaked material, is provided that includes a gravitational feeder having a plurality of outlets, wherein the feeder is configured to distribute the material through the outlets; a first plurality of cups fixed with respect to each other and disposed to rotate about a vertical axis, wherein each of the plurality of cups are sequentially positioned under all of the plurality of outlets during one complete revolution of the cups about the vertical axis; a bottom plate having a second plurality of passages therethrough, wherein the bottom plate abuts all of the cups and forms a bottom to each of the cups and is disposed underneath all of the cups; and a plurality of weigh buckets, each disposed to receive material from one of second plurality of passages and to sequentially and alternately weigh and dump portions of the material received from the first plurality of cups.

The apparatus may include a feed tube disposed to sequentially and alternatively receive portions of material weighed by the weigh buckets. The apparatus may also include a forming shoulder disposed to receive a web of package material and to form the web into a tubular column; a hollow tube surrounded by the forming shoulder having an outer surface to receive and support the tubular column and having an inner surface to receive and conduct the material; and a pair of cross-sealing jaws disposed below the hollow tube and disposed perpendicular to the longitudinal axis of the tubular column to sequentially seal portions of the tubular column therebetween. The first plurality of cups may be fixed to a cup plate to rotate in a plurality of start/stop cycles per each revolution about the vertical axis. Each of the start/stop cycles may have an angular length of N degrees where N equals 360 degrees divided by the product of the first plurality of cups and the second plurality of passages. The first plurality may be 3 and the second plurality may be 2.

In accordance with a third embodiment of the invention, an apparatus for volumetrically metering, weighing, and dispensing particulate or flaked material, is provided including a gravitational feeder having a first plurality of outlets, wherein the feeder is configured to distribute the material through the outlets; a top plate having a plurality of cups fixed with respect to each other and disposed to rotate about a vertical axis, wherein each of the plurality of cups are sequentially positioned under all of the first plurality of outlets during one complete revolution of the top plate about the vertical axis; a bottom plate having a second plurality of passages therethrough, wherein the bottom plate abuts all of the cups and forms a bottom to each of the cups and is disposed underneath all of the cups, wherein each of the plurality of cups are sequentially positioned under all of the second plurality of passages during one complete revolution of the top plate about the vertical axis; and a plurality of weigh buckets, each disposed to receive material from one of second plurality of passages and to sequentially and alternately weigh and dump portions of the material received from the first plurality of cups, wherein each of the plurality of cups are disposed to be filled at a first plurality of rotational positions and to be emptied at a second plurality of rotational positions, and further wherein when the top plate rotates in a first direction about the vertical axis and a precession of cup-filling and cup-emptying operations proceeds in a second direction opposite the first direction about the vertical axis.

The plurality of cups may include upper and lower nested cylinders, and the apparatus may further include a cup plate supported by the bottom plate for rotation about the vertical axis that is coupled to each of the lower cylinders, wherein the top plate is coupled to each of the upper cylinders. The apparatus may include a forming tube configure to support and enclosing tube of bag material; and a feed tube disposed between the forming tube and the plurality of weigh buckets and disposed to successively receive portions of bulk material released alternately by the plurality of weigh buckets and configured to channel the successively received portions of bulk material into a forming tube configured to form a tube of bag material.

DETAILED DESCRIPTION OF THE PREFERRED EMBODIMENT

Referring to FIG. 1, a packaging machine including an integral volumetric metering and check weighing feed system is disclosed. In the overall system 100 raw material is fed into a hopper 102 having a plurality of outlets 104. These outlets are disposed in a basin shaped top plate 106. The top plate has passages through which the raw material exiting outlets 104 is permitted to pass. Each of these outlets is disposed above a corresponding cup 108. In the preferred embodiment, there are two outlets 104 and there are three passages 110 through the top plate that are aligned with three cups 108. Each of the cups is coupled to a cup plate 112 and is supported on a bottom plate 114, which includes a thin low friction layer 116. Bottom plate 114 is coupled to two drop tubes or spouts 118 that receive material falling from the cups through two holes in bottom plate 114. Bottom plate 114 serves as a bottom to each of the cups and is held stationary along with the drop tubes. As each cup is rotated by cup plate 112, they are periodically and cyclically aligned with the passages in bottom plate 114 permitting the bulk material in each cup 108 to fall through the drop tube 118 over which it is positioned.

Drop tubes 118 direct the bulk material into weigh buckets 120 which are positioned below the drop tubes to receive the bulk material when it passes through the drop tubes. There are two drop tubes and two passages in bottom plate 114 with which they are associated and from which they receive bulk material. In addition, there are two weigh buckets 120, each disposed beneath one of the drop tubes to catch all of the bulk material passing therethrough. Each weigh bucket 120 has an open top that receives material from the drop tubes. The buckets include a pivotable receiver that is U-shaped with an enclosed bottom 126. Each receiver abuts a back plate 128, which closes the open part of the "U." When the receiver is in the position shown in FIGS. 1 and 2, the bucket is closed. Each receiver 124 is fixed to two arms 130 that are pivotally mounted at pivot 132 to back plate 128. A portion of the arm extends behind the back plate and is coupled to pneumatic actuator 134. When the actuator retracts, arms 130 pivot about pivot 132 causing the bottom of the bucket to move away from the back plate 128. When this happens, material is permitted to fall from the bucket into feed tube 136. Feed tube 136 extends substantially restriction free from its mouth to partially formed bag 138. As shown in FIG. 1, feed tube 136 is disposed under all of the buckets 120 to receive the bulk material and channel it into a single vertical path. Thus, as each bucket 120 sequentially weighs a portion of bulk material, each of those portions is combined into feed tube 136 filling successive bags.

Figure 2:
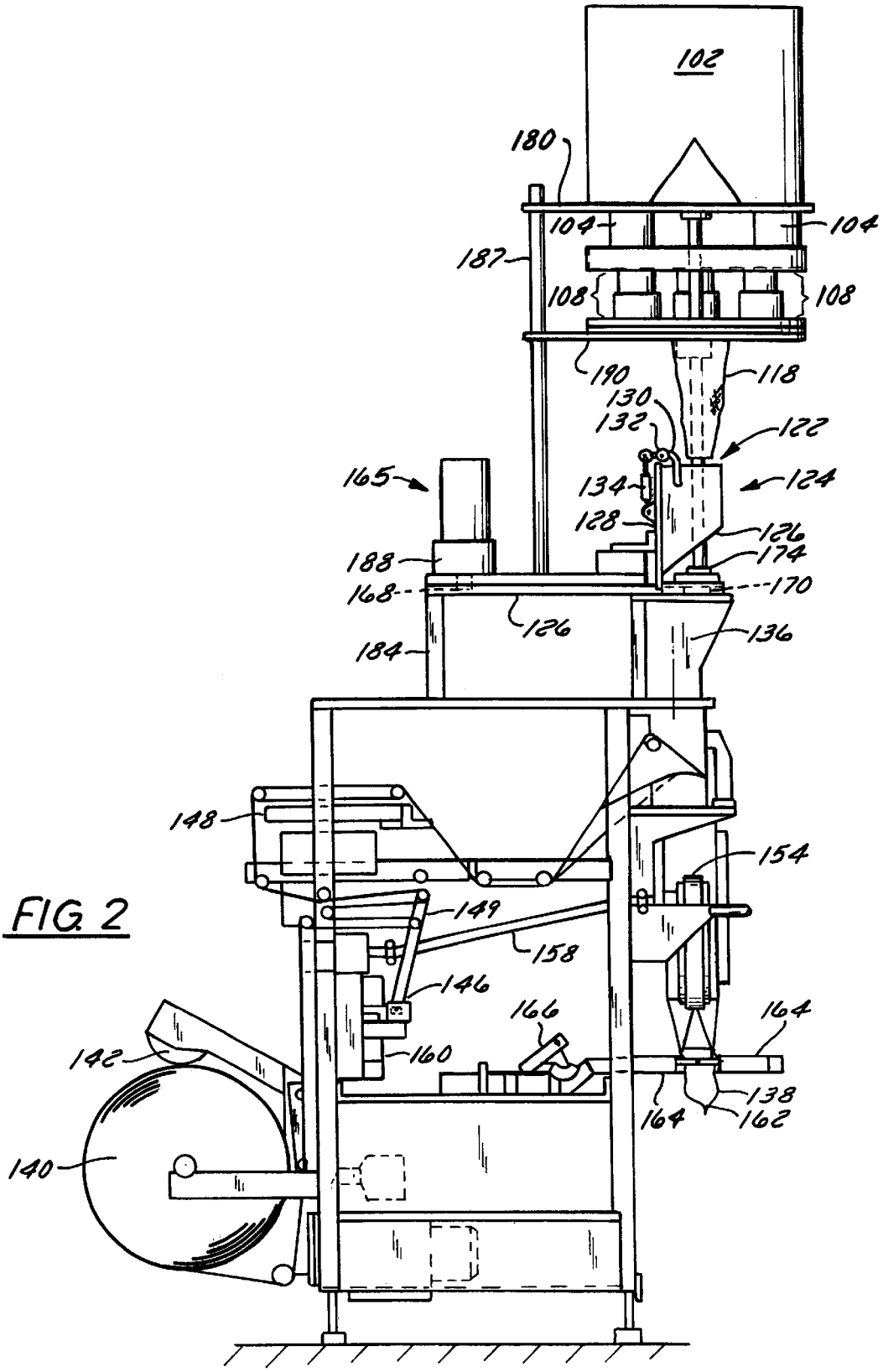
FIG. 2 is a side view of the apparatus of FIG. 1.

The bags are formed from a roll of raw material 140. This material is typically a polymeric material such as Mylar or high-density molecular weight polyethylene. The roll is advanced by a pre-unwind motor 142 which is in contact with the roll and ensures there is sufficient slack in the system to permit the material to be fed therethrough. This ribbon of material coming off roll 140 is directed through a sequence of horizontal rollers, including a pair of dancing rollers or a "dancer" 144 which maintains a certain portion of the material on the roll under a constant and relatively slight tension. Dancer 144 pivots its lower end 146 moving left and right as shown in FIG. 2 as material is pulled through the system. The material on roll 140 continues through the system around and through a swivel frame 148, which steers the material to the left and to the right keeping it in proper lateral alignment. Eventually, the web of material from roll 140 is pulled around a forming shoulder or collar 150. This shoulder 150 redirects the material such that it forms a tubular shape wrapping around feed tube 136 with a small amount of overlap. The overlap is positioned in front of the system as shown in FIG. 1 and is guided downward underneath a vertically extending hot shoe or sealing tool 152. Electricity provided to hot shoe 152 causes the overlapping portions of the web to melt and seal to each other forming a continuous tube.

The web material is drawn through the system by a pair of drive belts 154. These belts extend around drive rollers 156, which press against the now-sealed tube of web material. The drive belts are disposed in opposing relationships on opposite sides of the now tubular web and are driven at the same time and speed thereby ensuring that both belts pull the same amount of material through the system at the same rate. To increase the friction between the tubular web and the drive belts, a vacuum source (not shown) may be connected to the drive belts, and the drive belts may be provided with holes through which a vacuum can be pulled. With this arrangement, the pressure of the belts against the formed tube which is then pressed against stationary feed tube 136, can be reduced or eliminated, thus permitting the now tubular web to be pulled more easily. Drive wheels 156 are driven by a drive shaft 158 that, in turn, is driven by a motor 160. Belts 154 pull down the now-tubular web, including partially formed bag 138. Bag 138 is the bottom of the now tubular web material with a transverse portion 162 formed as a seal extending across the entire tubular web. This seal is formed by a pair of cross-sealing jaws 164 that face each other and are driven by mechanism 166. As the tubular web descends from the machine driven by belts 154, cross sealing jaws 164 move inward toward one another and seal against a portion of the tubular web. Each of the jaws includes an internal heating element (not shown) that causes the tubular web to melt and adhere to itself thereby creating a transverse seal. The cross sealing jaws 164 also include a cutter bar that is mounted transverse to the descending tubular web. This cutter bar severs bag 138 once a seal has been formed on the upper end of the bag thereby completely enclosing the bulk material in the bag in a sealed bag having a transverse seal both at the bottom end and at the top end. Completely formed bag 138 drops away from the machine. It is then labeled, printed, or boxed. These later processes are no part of the present invention.

A rotary drive unit 165 including an electrical motor drives an output shaft 168 in rotation. This output shaft includes a gear (or sprocket), which is engaged with and drives a chain (not shown). This chain extends away from drive unit 165 and is wrapped around and drivingly engages gear or sprocket 170 fixed to the bottom of main shaft 172. A bearing 174 is fixed to lower base plate 176 (as is drive unit 165) and supports main shaft 172. The upper end of main shaft 172 is held by a similar bearing 178 which is fixed to upper plate 180 is mounted on vertical column 182. Vertical column 182, in turn is fixed to lower base plate 176. Lower base plate 176, in turn, is supported on legs 184. Legs 184, in turn, are fixed to the rectangular chassis of the bagging and sealing portion of the system, which in turn is supported on the floor.

Drive unit 165 is preferably configured to start and stop several times during each complete revolution of main shaft 172, which the drive unit drives. The preferred way of doing this is to provide a planetary gear arrangement 188 coupled to the electrical motor in the drive unit and to start and stop that motor as required. Alternatively, a start/stop drive unit such a Geneva mechanism may be incorporated in the drive unit and the drive motor may be run continuously. Alternatively, drive unit 165 itself may be driven continuously to rotate main shaft 172 at a relatively constant speed (i.e. not in a start-stop manner) that permits the alternating metering and weighing of particulate matter.

Main shaft 172 supports bottom plate 114, which does not rotate with main shaft 172. Bottom plate 114, in supports cup plate 112 and low friction layer 116. Main shaft 172 also supports top plate 106. Main shaft 172 is rotationally coupled to both cup plate 112 and top plate 106 such that whenever drive unit 165 rotates shaft 172, both top plate 106 and cup plate 11 rotate as well.

Figure 3:
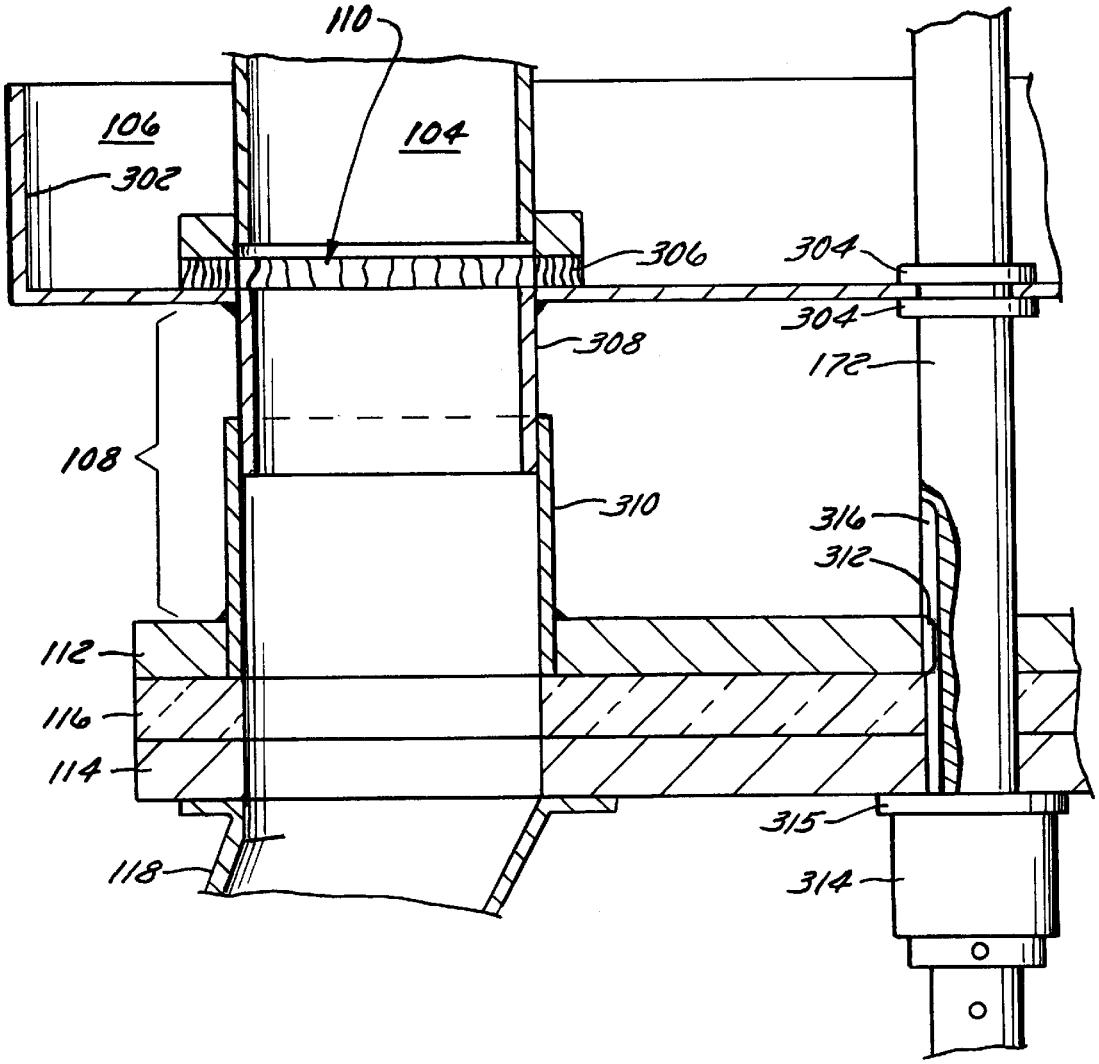
FIG. 3 is a fragmentary cross-sectional view of a portion of the outlet, a top plate, cups, a cup plate, a bottom plate and a drop tube of the apparatus of FIGS. 1 and 2.

FIG. 3 is a fractional cross sectional view of outlets 104, top plate 106, cups 108, passages 110, cup plate 112, bottom plate 114, and low friction layer 116. Outlets 104 extend downward from hopper 102 into top plate 106, which is formed as a circular pan or tray with a slightly upraised rim 302. The rim serves to keep bulk material that is being fed through hopper 102 from falling on the floor or on the machinery below. Outlet 104 is stationary. It is fixed to upper plate 180 (FIG. 2) and thus does not rotate when the machine is operating. Shaft 172 extends upward through the center of top plate 106 and is fixed to top plate 106, typically via locking collars or nuts 304. Whenever shaft 172 rotates top plate 106 rotates as well. Each of outlets 104 includes a leveling device 306 (here shown as a brush) that is fixed to the lower end thereof and sweeps across the floor of top plate 106. The leveling device or brush reduces the spillage from outlet 104 onto the bottom of top plate 106 and levels the top of the metered material in the cup thereby helping to maintain a constant volume in each cup as it is filled. As top plate 106 is rotated with respect to outlet 104 and brush 306, any loose bulk material is swept into the next passage 110 through top plate 106 that appears underneath outlet 104.

The cups 108 are in the form of two cylinders. A first cylinder 308 is fixed to and extends below top plate 106. Passage 110 defines the opening of first cylinder 308. Cylinder 308 is preferably circular in cross section, and is fitted into second cylinder 310. The lower portion of cylinder 310 is fixed to cup plate 112, which is keyed to shaft 172 via key 312 and rotates together with shaft 172 whenever shaft 172 is rotated by drive unit 166. Thus, the plates to which cylinders 308 and 310 of cup 108 are attached are simultaneously rotated by shaft 172, causing both cylinders 308 and 310 to rotate simultaneously with those plates. The volume collectively defined by cylinders 308 and 310 is equivalent to and defines the volume of bulk material metered by the system. Excess material filling the cylinders is swept away by brush 306, thus defining the top limit of the portion of bulk material metered by the system. The bottom is defined by low friction layer 116, which is supported on bottom plate 114. Cup plate 112 rests upon and rotates with respect to low friction layer 116 and bottom plate 114. It is driven by shaft 172, which acts through key 312 to rotate cup plate 112. Bottom plate 114 and low friction layer 116 are restrained from rotation by bracket 190 (FIG. 2), which is coupled to vertical column 182 to restrain the rotation of layer 116 and bottom plate 114. In this manner, low friction 116 and bottom plate 114 are prevented from rotating when shaft 172 rotates.

Both low friction layer 116 and bottom plate 114 define a passage that is oriented with the opening of cylinder 310. Whenever cylinder 310 is rotated into position above these openings, the bulk material that fills cup 108 falls through these openings and into drop tubes 118. Drop tubes 118 are fixed to the bottom of bottom plate 114 and direct the falling bulk material into weigh buckets 120.

The volume of cups 108 can be varied by raising and lowering bottom plate 114 with respect to top plate 106. This raising and lowering is provided by actuator 314, which is pinned to shaft 172. Actuator 314 expands or retracts in length in response to an electrical signal generated by the electronic controller for this system. It is pinned to shaft 172 and supports bottom plate 114, layer 116, and cup plate 112, including second cylinders 310. When it expands in length, its top portion 315 raises with respect to shaft 172. Since bottom plate 114, low friction 116, and cup plate 112 rest on actuator 314, they are also raised. Cup plate 112 is keyed to shaft 172 by key 312. Key 312 slides upward in key slot 316 thereby keeping cup plate 112 rotationally coupled to shaft 172 in a plurality of vertical positions. When cup plate 112 is raised, cylinder 310 moves upwards around the outer surface of cylinder 308. Since the two cylinders define the volume of each cup 108, this upward motion causes a reduction in cup volume, and hence a reduction in the volume of bulk material metered into each cup. A similar increase in cup volume can be created by lowering the upper portion of actuator 314 thereby causing cylinder 310 to slide downward in respect to cylinder 308.

In FIG. 3, outlet 104, top plate 106, passages 110, cylinders 308 and 310, cup plate 112, low friction layer 116, and bottom plate 114 are shown as forming one long continuous path through the system. This is not the orientation that they have in reality. If it were, cups 108 would provide no metering capability. As soon as outlet 104 was positioned over passage 110, an unlimited quantity of bulk material would fall through the continuous passage formed by these elements until virtually the entire system was filled with bulk material.

FIG. 3 illustrates these elements as being vertically aligned simply for convenience of illustration. In fact, they are rotationally staggered in a specific fashion that permits cups 108 to be filled in one position and emptied in a second position. For this reason, when outlet 104 is oriented over the top of cup 108, low friction layer 116 and bottom plate 114 are not in the position shown in FIG. 3. In fact, they are rotated to a different position in which the passages through bottom plate 114 and 116 are not below cup 108. In this position, low friction layer 116 and bottom plate 114 provide a solid base to cup 108 thus permitting the cup to be filled. In a similar fashion, when the openings in low friction layer 116 and bottom plate 114 are in the position shown in FIG. 3 to permit the bulk material previously placed in cup 108 to fall into drop tube 118, outlet 104 is not positioned above cup 108.

Figure 4A:
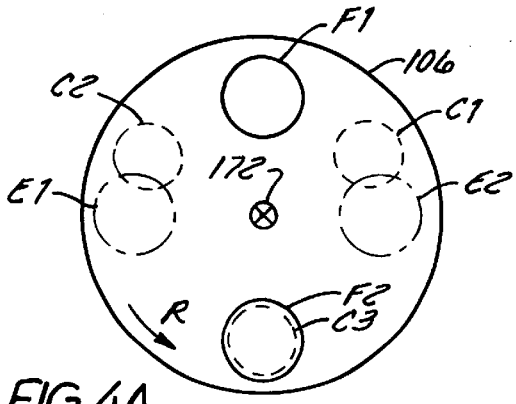
FIGS. 4A–4G illustrate the orientation of the hopper outlets, the cups and the passages through the bottom plate with respect to each other as the cups are rotated (together with the top plate and the cup plate) to several sequential rotational positions by the motor drive unit during normal operation of the apparatus.
Figure 4B:
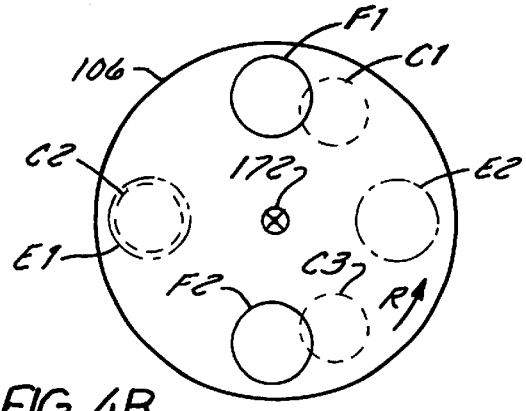

To illustrate the angular position of the outlets, passages in top plate 106, the location of cups 108 in cup plate 112, and the passages through low friction layer 116 and bottom plate 114 (as well as the openings of drop tubes 118 coupled to bottom plate 114) FIGS. 4A–4G have been provided. These figures illustrate the sequence of positions of the foregoing items as top plate 106 and bottom plate 114 are rotated through 180 degrees. The direction of rotation is indicated by arrow "R." Solid circles F1 and F2 indicate the size and position of outlets 104 just above top plate 106. Dashed circles C1, C2, and C3 indicate the location of each of the three cups 108 as they are rotated 180 degrees. Dashed/dotted circles E1 and E2 indicate the location of the passages through low friction layer 116, and bottom plate 114, as well as the inlets to drop tubes 118. FIG. 4 illustrates that outlets 104 (circles F1, F2) are disposed in a 180-degree relation to each other. Since, in this embodiment, there are two drop tubes 118, each associated with its own weigh bucket, there are two inlets to the drop tubes located adjacent to the outlets through the bottom plate to receive material passing through the bottom plate outlets. FIG. 4 illustrates these outlets through low friction layer 116, bottom plate 114, and the opening to drop tube 118 (dot/dash circles E1, E2). They are disposed in a 180-degree relationship to each other about main shaft 172. In addition, circles F1 and F2 are spaced 90 degrees away from circles E1 and E2. This indicates that each cup 108 (circles C1, C2, and C3) is filled as it rotates through a 90 degree angle before it can be emptied. Referring now to FIG. 4A, we have taken an arbitrary start position for each of the components identified above to illustrate the sequence of positions through a 180-degree revolution of the top plate and cup plate. It should be understood that the idea of a "starting position" for a continuous rotational process is purely arbitrary. In the position of FIG. 4A, the cup 108 that is disposed directly underneath passage 110 of one of outlets 104 (i.e. cup C3 and outlet F2) is positioned to receive bulk matter poured into the cup. In this position, bulk material in the hopper pours into cup C3. Note that passage through layer 116, plate 114, and the inlet to drop tube 118 (i.e. circle E1 and E2) are not located near cup C3. The bottom of cup C3 therefore abuts the flat planar surface of layer 116 and plate 114 preventing the bulk material from pouring out of cup C3. The other outlet 104 (circle F1) is blocked by the bottom of top plate 106. The passages 110 through top plate 106 indicated by circles C1, C2, and C3 are disposed away from the outlet indicated by circle F1. Hence, as cups C3 is filled through outlet F2, nothing passes through the other outlet, (circle F1) which is blocked. Cup C2 is partially overlapping with the passages in layer 116, bottom plate 114, and the opening of drop tube 118 as indicated by the overlap between circles E1 and C2. As the cycle progresses, (FIG. 4B) cup C2 will be positioned directly above the passages through low friction layer 116 and bottom plate 114 and all the contents of cups C2 will empty through those passages and through drop tube 118 into one of weigh buckets 120. In a similar fashion, cup C1 has just been emptied through the other passage through plate 114, layer 116, and drop tube 118 as indicated by the small overlap between circle C1 and circle E2. FIG. 4B represents the next position in the machine cycle. Cup C3, now filled, is moving away from outlet F2. Cup C2 is now aligned with the passage through layer 116, bottom plate 114, and above the inlet in drop tube 118. In this position, all of the contents of cup C2 are dumped into one of weigh buckets 120. The other weigh bucket, which receives bulk matter from a cup when that cup is positioned above circle E2 does not receive anything, since no cup is positioned over circle E2. Cup C1 is just moving into position beneath outlet F1 and has just started to filled with bulk material.

Figure 4C:
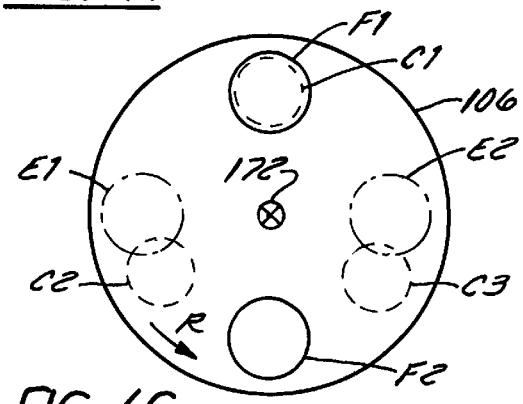

In FIG. 4C, cup C2 has been completely emptied and is now moving away from passages through layer 116 and plate 114 indicated by circle E1. In a similar fashion, cup C3 previously filled by outlet F2 is now moving into its dumping position when it is positioned over passages through layer 116 and plate 114 indicated by circle E2. At this stage, cup C1 is being filled and/or has been filled by outlet F1.

Figure 4D:
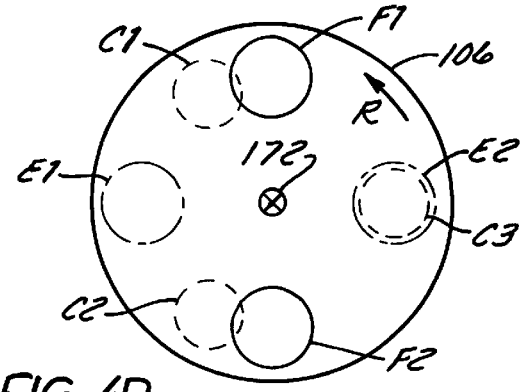

Referring to FIG. 4D, cup C3 is oriented directly on top of the passages through layer 116 and bottom layer 114 indicated by circle E2. Cup C1 has been completely filled and is moving away from outlet F1, while cup C2 is moving into position underneath outlet F2 to be filled. Since no cup is positioned over the passages through layer 116, plate 114, and the inlet of drop tube 118 (indicated by circle E1) no bulk material is received by the weigh bucket positioned under circle E1.

Figure 4E:
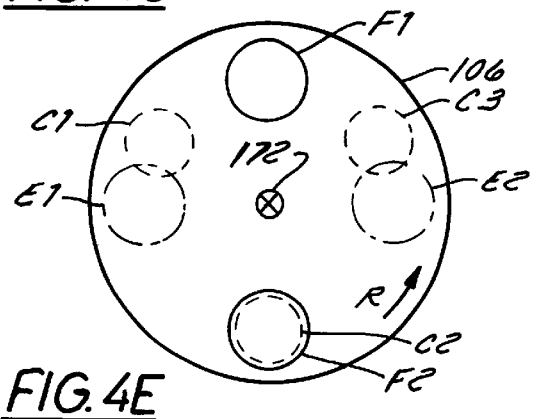

In FIG. 4E, cup C2 is being filled at outlet F2. Outlet F1 is blocked. Cup C3, now empty, is moving toward outlet F1 to be filled. Cup C1 is moving towards the passage through layer 116, plate 114, and drop tube 118 to be emptied, and indeed has started to empty as indicated by the overlap between circle C1 and E1.

Figure 4F:
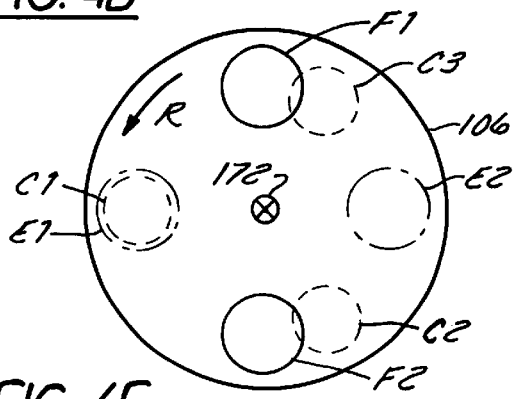

In FIG. 4F, cup C1 is positioned over circle E1 and has completely emptied into weigh bucket 120 disposed underneath that passage through layer 116 and bottom plate 114. Nothing is being dumped through the other drop tube and passages through layer 116 and plate 114 as indicated by circle E2. Cup C3 is moving into position under outlet F1 and has just begun to fill. Cup C2, now full, is moving away from hopper outlet F2.

Figure 4G:
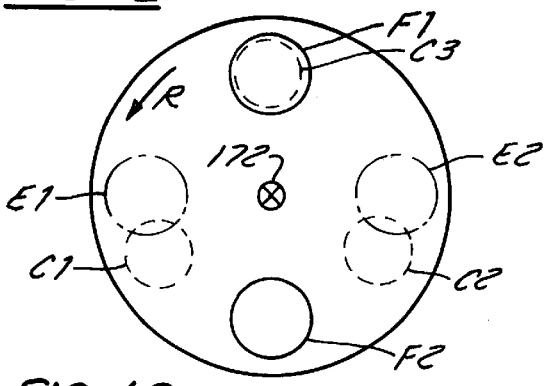

In FIG. 4G, cup C3, which was previously filled at outlet F2 (FIG. 4) and subsequently emptied at circle E2 (FIG. 4D) is again being filled at outlet F1. Outlet F2 is blocked and no bulk material passes therethrough. Cup C2 is just moving into its emptying position as indicated by its overlap with circle E2 and cup C1, now empty, is moving away from its emptying position (as indicated by circle E1) and towards outlet 104 (indicated by circle F2).

The foregoing FIGS. 4A–4G describe a 180 degree revolution of the cups (and top plate 106 and cup plate 112 to which they are coupled) about shaft 172. Each of the foregoing steps is repeated in order to make a complete revolution of shaft 172.

The steps illustrated in FIGS. 4A–4G can be summarized as follows. First, one cup fills. Then, another cup empties. Then, another cup fills from a different outlet. Then, a third cup empties from another outlet. The cups are alternatively filled first from one outlet and then from the other outlet. The cups are alternatively emptied first into one weigh bucket, and then into the other weigh bucket. The weigh buckets are also filled alternatively. The process of filling and emptying proceeds in a direction opposite the direction of physical rotation of the cups. As shown in FIGS. 4A–4G, the cups always rotate in a counter clockwise direction. The filling and emptying proceeds in the opposite direction: clockwise. In FIG. 4A, the cup in the six o'clock position is filled. In FIG. 4B, the cup in the nine o'clock position is emptied. In FIG. 4C, the cup in the twelve o'clock position is filled. In FIG. 4D the cup in the three o'clock position is emptied. In FIG. 4E the cup in the six o'clock position is filled. In FIG. 4G the cup in the nine o'clock position is emptied. In FIG. 4G the cup in the twelve o'clock position is filled. Thus, as the cups and the plates to which they are fixed move in a counter clockwise direction indicated by arrow "R" the process of filling and emptying proceeds in the opposite, clockwise, direction. The direction can be determined by noting the angular displacement between successive machine steps of filling and emptying. Thus, from the cup filling step at circle F2 to the very next step of cup emptying at circle E1 is less than 180 degrees, and since each successive step was in that same clockwise direction as indicated by being less than 180 degrees from the previous step, the filling and emptying steps are said to proceed in a clockwise direction, a direction opposite the counter clockwise direction of rotation of top plate 106 and cup plate 112, the direction of filling is said to be in the opposite direction as the rotation of the cups.

While the embodiments illustrated in the FIGURES and described above are presently preferred, it should be understood that these embodiments are offered by way of example only. The invention is not intended to be limited to any particular embodiment, but is intended to extend to various modifications that nevertheless fall within the scope of the appended claims.

For example, the main shaft and the unit driving it need not operate in a start/stop fashion as it moves between each position in which a cup is filled and emptied. Depending upon a variety of factors including (among others) the diameter of the cups, their angular spacing, the fragility of the material being metered and the like, the main shaft and the unit that drives it may operate at a constant speed, may start and stop, or may operate at a variable speed.

As another example, the number of cups, hoppers, hopper outlets, bottom plate passages, drop tubes and weigh buckets can all vary and still provide the benefits of this invention.

As yet another example, the components may be sized so that each operation (i.e. cup filling, cup moving, cup dumping, material weighing and dumping of weighed material) may overlap with another operation and need not be started and completed before the next operation begins. The operations are staggered. Thus, for example, as one weigh bucket is in the process of filling, another may be in the process of weighing. As one weigh bucket is in the process of weighing, another weigh bucket may be in the process of emptying. As one cup is emptying, another may be filling. This can be seen in the FIGURES above. As the cup plate rotates, there are several positions in which a filled cup is beginning to move over the aperture in the bottom plate at the same time, another cup is just moving away from (but is still positioned slightly under) one of the outlets of the hopper.

What is claimed is:

1. A cup filler for volumetrically metering, weighing, and dispensing particulate material, comprising:

a hopper having an inlet and first and second outlets that is configured to receive and distribute the material through the outlets;

a top plate disposed horizontally and fixed to a shaft to rotate with the shaft about a vertical axis and having first, second, and third passages extending through the top plate;

a cup holder plate disposed horizontally and fixed to the shaft to rotate with the shaft about a vertical axis and having first, second, and third openings extending through the cup holder plate;

first, second and third cups extending vertically and fixed between the first, second and third openings of the top and cup holder plates;

a bottom plate abutting the cup holder plate and having first and second passages therethrough; and a motor drive unit drivingly coupled to the shaft to rotate the top plate, and the cups with respect to the bottom plate, wherein the first and second outlets of the hopper, the first, second and third cups and the first and second passages through the bottom plate are angularly disposed with respect to each other such that when the top plate, cups and cup holder plate are rotated by the motor drive unit, the cups empty in an alternating sequence and the hopper fills the cups in an alternating sequence.

2. The cup filler of claim 1, further comprising first and second weigh buckets disposed below the first and second passages through the bottom plate to receive material passing through the first and second passages in the bottom plate in an alternating sequence, and also to empty in an alternating sequence.

3. The cup filler of claim 2, wherein the passages in the bottom plate are disposed in a 180-degree relation with respect to each other about the axis of the shaft.

4. The cup filler of claim 3, wherein the cups are disposed in a 120-degree relation with respect to each other about the axis of the shaft.

5. The cup filler of claim 4, wherein each hopper outlet is spaced 90 degrees from each passage in the bottom plate about the axis of the shaft.

6. The cup filler of claim 1, wherein the motor drive unit is configured to drive the cups about the shaft in at least six start-stop rotational sequences.

7. A apparatus for volumetrically metering, weighing, and dispensing particulate material, comprising:

a gravitational feeder having a plurality of outlets, wherein the feeder is configured to distribute the material through the outlets;

a first plurality of cups fixed with respect to each other and disposed to rotate about a vertical axis, wherein each of the first plurality of cups are sequentially positioned under all of the plurality of outlets during one complete revolution of the cups about the vertical axis; and a bottom plate having a second plurality of passages therethrough, wherein the bottom plate abuts all of the cups and forms a bottom to each of the cups and is disposed underneath all of the cups, wherein the cups are angularly arranged about the vertical axis and the plurality of outlets are arranged about the vertical axis such that material in the cups is sequentially and alternately released from the cups through the plurality of outlets as the cups are rotated about the vertical axis.

8. The apparatus of claim 7, further comprising:

a plurality of weigh buckets, each disposed to sequentially and alternately receive material from one of second plurality of passages and to sequentially and alternately weigh and dump portions of the material received from the first plurality of cups; and a feed tube disposed to sequentially and alternatively receive portions of material weighed by the weigh buckets.

9. The apparatus of claim 8, further comprising:

a forming shoulder disposed to receive a web of package material and to form the web into a tubular column; and a hollow tube surrounded by the forming shoulder having an outer surface to receive and support the tubular column and having an inner surface to receive and conduct the material; and a pair of cross-sealing jaws disposed below the hollow tube and disposed perpendicular to the longitudinal axis of the tubular column to sequentially seal portions of the tubular column therebetween.

10. The apparatus of claim 7, wherein the first plurality of cups are fixed to a cup plate to rotate in a plurality of cycles per each revolution of the cup plate about the vertical axis, and further wherein each of the cycles has an angular length of N degrees where N equals 360 degrees divided by the product of the first plurality of cups and the second plurality of passages through the bottom plate.

11. The apparatus of claim 10, wherein the first plurality is 3 and the second plurality is 2.

12. A apparatus for volumetrically metering, weighing, and dispensing particulate material, comprising:

a gravitational feeder having a first plurality of outlets, wherein the feeder is configured to distribute the material through the outlets;

a first plate having a plurality of cups fixed with respect to each other and disposed to rotate about a vertical axis, wherein each of the plurality of cups are sequentially positioned under all of the first plurality of outlets during one complete revolution of the top plate about the vertical axis;

a bottom plate having a second plurality of passages therethrough, wherein the bottom plate abuts all of the cups and forms a bottom to each of the cups and is disposed underneath all of the cups, wherein each of the plurality of cups are sequentially positioned over all of the second plurality of passages during one complete revolution of the top plate about the vertical axis; and a plurality of weigh buckets, each disposed to receive material from one of second plurality of passages and to sequentially and alternately weigh and dump portions of the material sequentially received from the first plurality of cups, wherein each of the plurality of cups are disposed to be filled at a first plurality of rotational positions and to be emptied at a second plurality of rotational positions.

13. The apparatus of claim 12, wherein each of the plurality of cups includes upper and lower nested cylinders, and wherein the apparatus further comprises a cup plate supported by the bottom plate for rotation about the vertical axis wherein the cup plate is coupled to each of the lower cylinders, and wherein the top plate is coupled to each of the upper cylinders.

14. The apparatus of claim 13, further comprising:

a forming tube configured to support a tube of bag material; and a feed tube disposed between the forming tube and the plurality of weigh buckets and disposed to successively receive portions of bulk material released in an alternating manner by the plurality of weigh buckets and configured to channel the successively received portions of bulk material into a forming tube configured to form a tube of bag material.

* * * * *